United States Patent [19]

Morel, Jr. et al.

[11] Patent Number: 5,022,356

[45] Date of Patent: Jun. 11, 1991

[54] ROLLER VALVE LIFTER WITH ANTI-ROTATION MEMBER

[75] Inventors: Edward J. Morel, Jr., Medina; Joe W. Morel, Rocky River, both of Ohio

[73] Assignee: Gear Company of America, Inc., Cleveland, Ohio

[21] Appl. No.: 593,091

[22] Filed: Oct. 5, 1990

[51] Int. Cl.[5] ..... F01L 1/14

[52] U.S. Cl. ..... 123/90.5; 123/90.35; 123/90.48

[58] Field of Search ..... 123/90.35, 90.48, 90.5, 123/90.55

[56] References Cited

U.S. PATENT DOCUMENTS

| | | | |
|---|---|---|---|
| 3,108,580 | 3/1963 | Crane, Jr. | 123/90.5 |
| 3,139,076 | 8/1961 | Flaherty | 123/90.5 |
| 3,668,945 | 6/1972 | Hofmann | 123/90.5 |
| 3,795,229 | 3/1974 | Weber | 123/90.5 |
| 3,886,808 | 6/1975 | Weber | 123/90.5 |
| 3,977,370 | 8/1976 | Humphreys | 123/90.5 |
| 3,998,190 | 12/1976 | Keske | 123/90.5 |
| 4,326,484 | 4/1982 | Amrhein | 123/90.5 |
| 4,387,674 | 6/1983 | Connell | 123/90.48 |
| 4,406,257 | 9/1983 | Keske et al. | 123/90.48 |
| 4,524,731 | 6/1985 | Rhoads | 123/90.55 |
| 4,607,599 | 8/1986 | Buente et al. | 123/90.5 |
| 4,704,995 | 11/1987 | Soeters, Jr. | 123/90.5 |
| 4,741,298 | 5/1988 | Rhoads | 123/90.5 |
| 4,771,741 | 9/1988 | Leer | 123/90.5 |
| 4,793,295 | 12/1988 | Downing | 123/90.5 |
| 4,809,651 | 3/1989 | Gerchow et al. | 123/90.5 |
| 4,876,944 | 10/1989 | Speil et al. | 123/90.5 |

FOREIGN PATENT DOCUMENTS

| | | | |
|---|---|---|---|
| 2920075 | 11/1980 | Fed. Rep. of Germany | 123/90.35 |

*Primary Examiner*—David A. Okonsky
*Assistant Examiner*—Weilun Lo
*Attorney, Agent, or Firm*—Watts, Hoffmann, Fisher & Heinke

[57] ABSTRACT

A roller valve lifter and member for preventing rotation of the lifter in its bore, especially useful for high speed automotive internal combustion engines. The lifter has a flat or non-cylindrical portion along its length. A non-movable member has an elongated portion received within the bore that cooperates with the non-cylindrical portion to prevent rotation. The non-movable member is located along one side in the bore, out of alignment with a transverse oil passage that communicates with plural lifter bores in series.

12 Claims, 4 Drawing Sheets

ROLLER VALVE LIFTER WITH ANTI-ROTATION MEMBER

TECHNICAL FIELD

This invention relates to roller valve lifters for internal combustion engines and more particularly to such valve lifters and members for preventing rotation of the lifters in high speed automotive engines.

BACKGROUND ART

Valve lifters or tappets in some internal combustion engines, especially high speed automotive engines, use rollers that ride in contact with the cams of cam shafts that operate the valve lifters; i.e., that reciprocate the lifters, which are cylindrical, in cylindrical bores of the engine block. It is necessary to prevent the valve lifters from rotating in the bores in order to keep the rollers properly aligned with the cams. Lifters are typically aligned in a row along a cam shaft and are lubricated by a straight and common transverse oil passage that intersects the bores, either centrally or tangentially. Serial flow of oil through successive bores is facilitated by a peripheral groove in each lifter body. The portion of the body above and below the groove prevents loss of lubricating oil through the open ends of the bores in which the lifters reciprocate and extend.

A known approach to preventing rotation of the lifters in the bores in high speed automotive engines is to utilize a link pivotably connected at opposite ends to portions of two adjacent lifters that extend above the bores, as shown in U.S. Pat. No. 4,809,651, or to use a bar that lies on the flat surface of the engine block at the top of the bores for the valve lifters. The bar extends between and cooperates with two adjacent lifters, acting as a key to prevent rotation while allowing reciprocation, and is held in place by springs or by a suitable clamping mechanism. See, e.g., U.S. Pat. No. 3,108,580.

Valve lifters of an engine that apparently does not provide an oil passage between adjacent bores for lubrication are disclosed as being prevented from rotation by a spring clip that is located in the central plane between adjacent valve lifter bores and that is received in two adjacent bores to cooperate with flat portions of the lifters to prevent rotation. See U.S. Pat. No. 3,998,190.

The above approaches are disadvantageous, in that a link pivoted to two lifters adds moving weight, requires additional assembly steps, requires additional length to the lifters that must extend above the block, requiring headroom and requires that the lifters be made and sold in pairs. A key requires springs or clamps to retain the part in place and requires structure extending above the engine block to accommodate the key and springs or clamps and typically requires additional height of the lifter. The spring clip arrangement in U.S. Pat. No. 3,998,190 avoids many of those shortcomings, but is not applicable to an engine in which lubrication of the lifters is accomplished through an oil passage that intersects the bores to bring oil sequentially to the bores and lifters, as is the case in typical automotive engines and particularly in high speed automotive internal combustion engines.

SUMMARY OF THE INVENTION

The present invention provides improved valve lifters and members for preventing rotation of the lifters in open-ended cylindrical bores of an internal combustion engine of the type in which oil is fed to and through the bores via a transverse oil passage that intersects and thereby communicates with the bores intermediate the ends of the bores and carries lubricating oil under pressure serially from one bore and lifter to the next, in line. The lifters are of the type that have a roller supported at a lower end and operated by a cam shaft that extends parallel to the oil passage. The invention finds specific utility in high speed automotive internal combustion engines.

A valve lifter as contemplated by the present invention has a body that is in major part cylindrical and in minor part non-cylindrical or of a different cylindrical curvature than the major part, the minor part extending parallel to the cylindrical axis of the major part the full axial length of the body and the major cylindrical part being of a size sufficient to obturate the oil passage of the engine block, a roller cam follower supported for rotation in one end of the body about an axis transverse to the cylindrical axis, and a passage through the body parallel to the axis of rotation of the roller, opening only through the major cylindrical part of the body and of a size that overlaps the oil passage during reciprocation of the lifter in the bore.

Rotation of the valve lifter is prevented in accordance with the invention by a member that extends into the bore of the engine block in which the valve lifter is located, at a stationary location out of alignment with the oil passage and in engagement with the minor part of the lifter body to restrain rotation of the body about its axis without interfering with reciprocation.

In a preferred embodiment of the invention, the anti-rotation member at least in part is generally omega-shaped and fits into two spaced parallel valve lifter bores of an internal combustion engine. The member has two leg portions, a transverse portion connecting upper ends of the two leg portions, and a transverse foot portion at a lower end of each of the two leg portions. The foot portion is shorter in length than the diameter of the lifter bores. The leg portions, connecting portion, and foot portions all lie in a common plane and the leg portions are of a length sufficient to extend entirely through the lifter bores. The member is formed from flat material and unbent, essentially free of internal stress and insertable in the lifter bores without deformation.

DESCRIPTION OF THE PREFERRED EMBODIMENT

Figure 1:
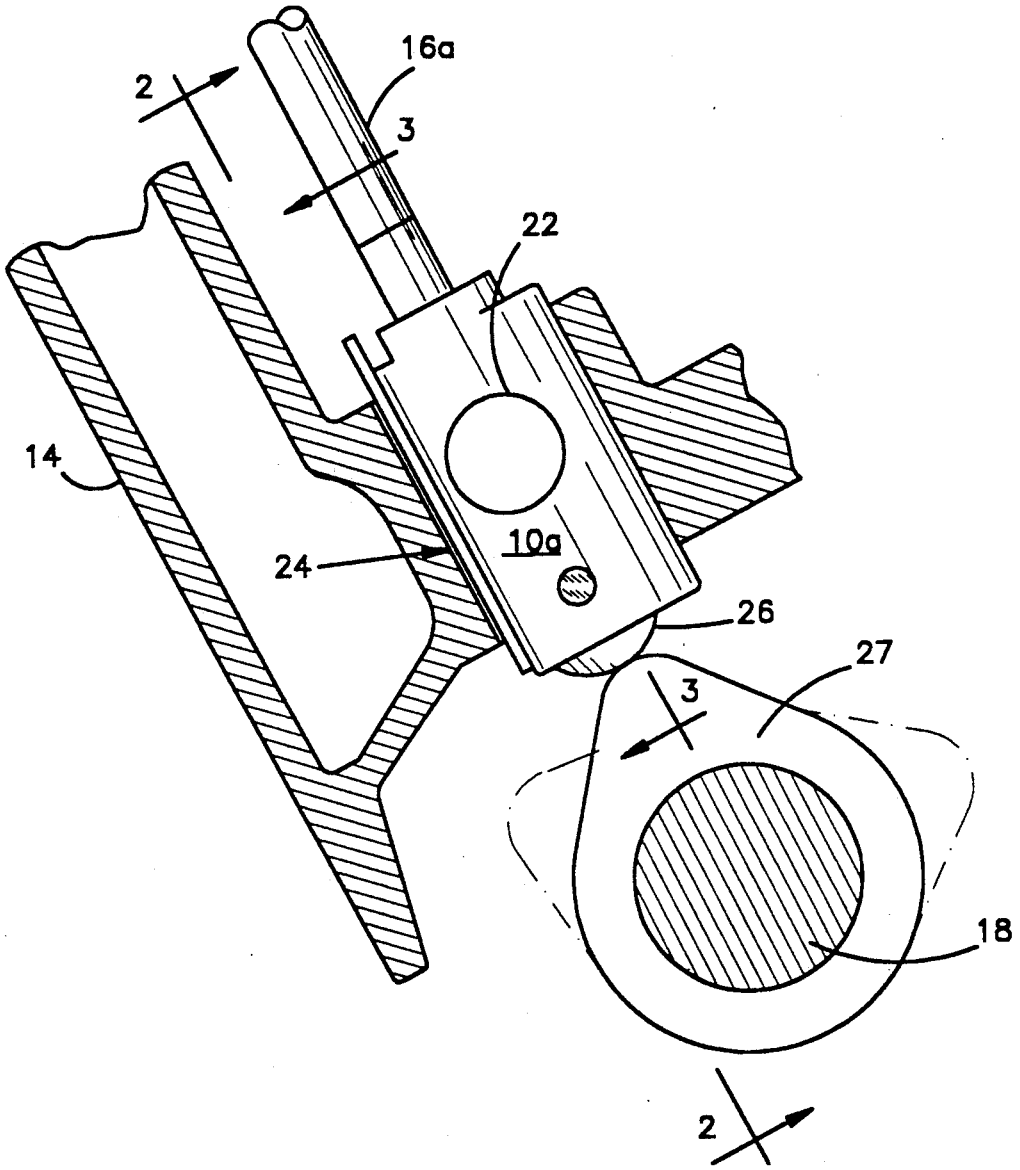
FIG. 1 is a partial cross sectional view with parts in elevation of an internal combustion engine block incorporating a valve lifter and member for preventing rotation of the lifter constructed in accordance with the present invention.
Figure 2:
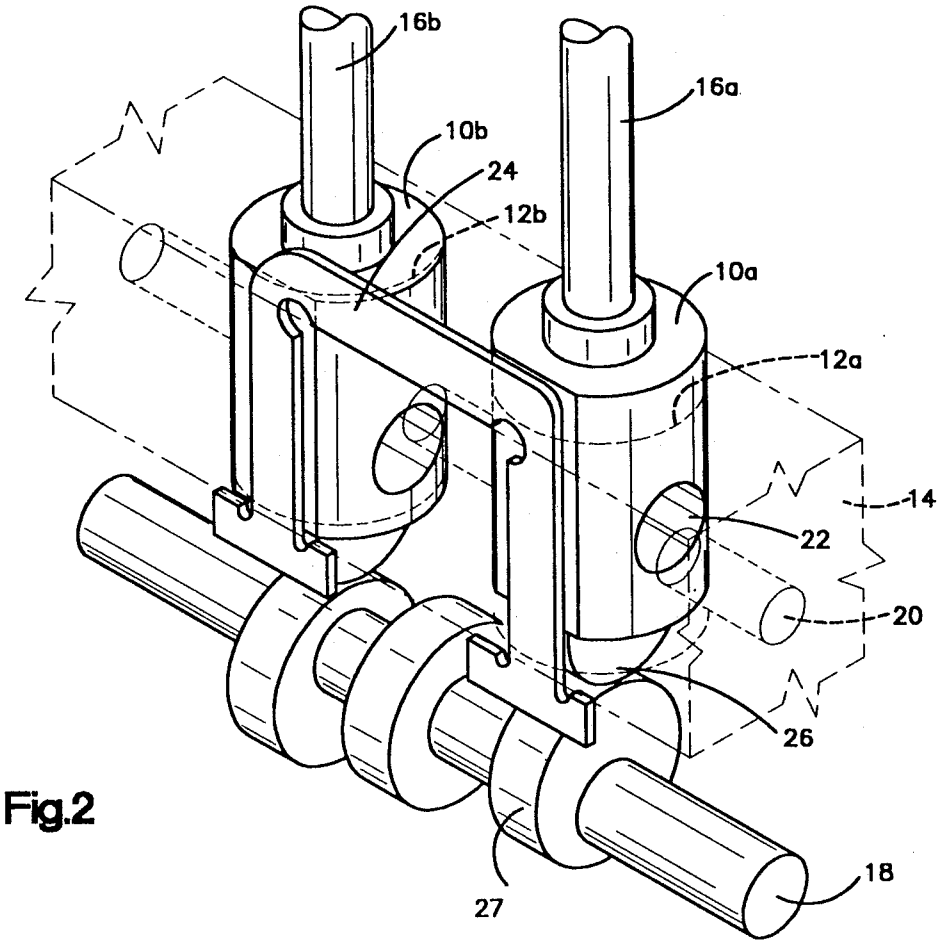
FIG. 2 is a partial diagrammatic isometric view of the apparatus shown in FIG. 1 viewed from the plane of the line 2—2, with parts in phantom, illustrating two adjacent valve lifters and the member that prevents rotation.

With reference to the accompanying drawings, roller valve lifters 10*a*, 10*b* are shown received in open-ended cylindrical bores 12*a*, 12*b* of an internal combustion engine block 14. In the embodiment shown, each cylinder (not shown) of the block has two valves and the lifters 10*a*, 10*b* operate pushrods 16*a*, 16*b* in response to rotation of a camshaft 18 to control opening and closing of the valves for one of the engine cylinders. Additional bores and lifters are provided in the block aligned with the camshaft for operating the valves of additional cylinders, as is conventional. An oil passage 20 parallel to the camshaft is formed in the block and intersects the bores 12*a*, 12*b* and successive bores associated with additional cylinders. In the embodiment shown, the oil passage intersects the bores intermediate the open ends and centrally, but in some engines the passage will intersect the bores tangentially. Oil flows through the oil passage under pressure to each bore, successively, and the lifters have central transverse passages 22 to permit such flow. A flat, generally omega-shaped, anti-rotation member 24 is received within two adjacent bores 12*a*, 12*b* and additional members 24 are received in successive pairs of bores. These members are retained in the bores by the lifters and cooperate with the lifters to prevent relative rotation of the lifters in the bores while allowing reciprocation, thereby keeping rollers 26 of the lifters aligned with the actuating cams 27 of the camshaft.

The lifters 10 are all identical in the embodiment shown. Each has a body 28 that has a major cylindrical part 28*a* and a minor planar part 28*b* that extends axially the full length of the body. The oil passage 20 in the block is cylindrical and of a diameter smaller than the diameter of the bores 12 and bodies 28. The major cylindrical part of each body is large enough to obturate the oil passage 20. The transverse cylindrical passage 22 in the body is located entirely within the major cylindrical part 28*a* and serves not only to allow the flow of lubrication oil through successive lifters, but also reduces the weight of the lifters. The diameter of the passage 22 is of the same order of magnitude as the diameter of the oil passage 20. For example, in a typical engine of the type diagrammatically shown, the oil passage 20 in the engine block is 7/16 inch in diameter, the diameter of the passage 22 in the lifter is 9/16 inch, and the stroke of the lifter is approximately ½ inch. It is preferred that the passage 22 be so located in the lifter, and be of a diameter with respect to the oil passage 20 and the stroke of the lifter, that the passage 22 will always at least partially overlap the oil passage 20. Small bores 30, 31 extend in opposite directions from the passage 22 to the exterior of the lifters to lubricate the bores 12 and a small bore 32 extends axially upward, communicating with a recess 34 that receives the lower end of a pushrod 16, supplying oil under pressure to the pushrod to lubricate a rocker arm of the valve operating mechanism (not shown).

The roller 26 is carried in the lower end of the body 28, supported by pin bearings 36 about a fixed axle 38. The central axis of the axle 38 passes through the central axis of the body 28 and is parallel to and below the transverse passage 22. The peripheral surface 26*a* of the roller 26 is cylindrical and of approximately the same width and is aligned with the planar portion 28*b* of the body. The roller is almost entirely received within a slot 40 of the body.

Figure 6:
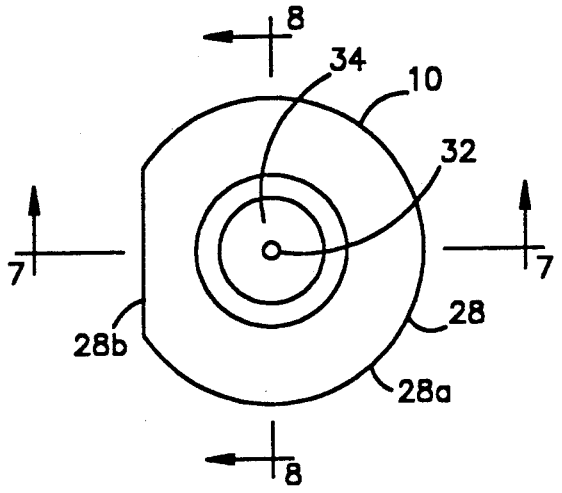
FIG. 6 is a top plan view of a valve lifter embodying the invention.
Figure 7:
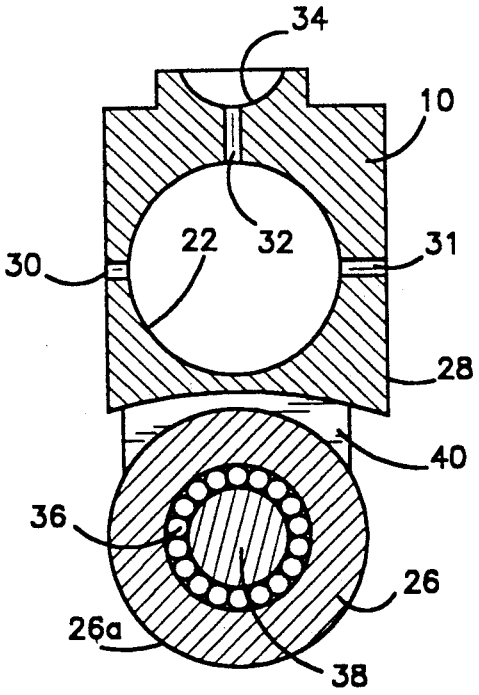
FIG. 7 is a longitudinal sectional view of the valve lifter of FIG. 6, taken along the line 7—7.
Figure 8:
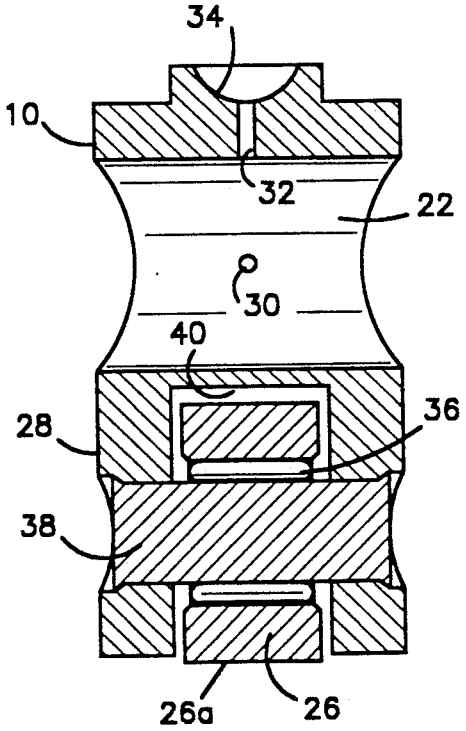
FIG. 8 is a longitudinal sectional view of the valve lifter of FIG. 6, taken along the line 8—8.

As best shown in FIGS. 6 and 7, the planar portion 28*b* is as large as possible to provide enough surface to coact with the member 24, while yet maintaining sufficient cylindrical area 28*a* to keep the planar portion 28*b* from exposing the oil passage 20 and to keep it radially beyond the periphery of the roller, so the roller does not contact the member 24. The roller diameter and the diameter of the bores 12 are set by the engine manufacturer. In one engine block with which the present invention is useful, by was of example, the bores 12 are 0.843 inch in diameter and the required rollers are 0.750 inch in diameter, for a difference of 0.093 inch. Since the roller axis is on the central longitudinal axis of the body 28, half of the difference, or approximately 0.045 inch, is all the radial depth that can be used to provide the planar surface 28*b* if contact between the roller and the member 24 is to be avoided. The planar part is located in alignment with the roller periphery because it is desired to locate the member 24 to one side of the oil passage 20 so as to not obstruct flow to successive bores 12. This has the added advantage, as compared with a flat portion displaced 90° about the body, of keeping the wall thickness that supports the ends of the axle 38 as great as possible, increasing the load-bearing capacity of the lifter.

Figure 4:
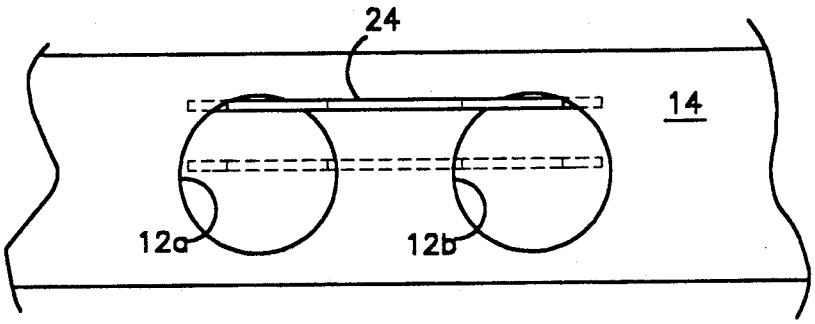
FIG. 4 is a top plan view taken along the line 4—4 of FIG. 3.
Figure 3:
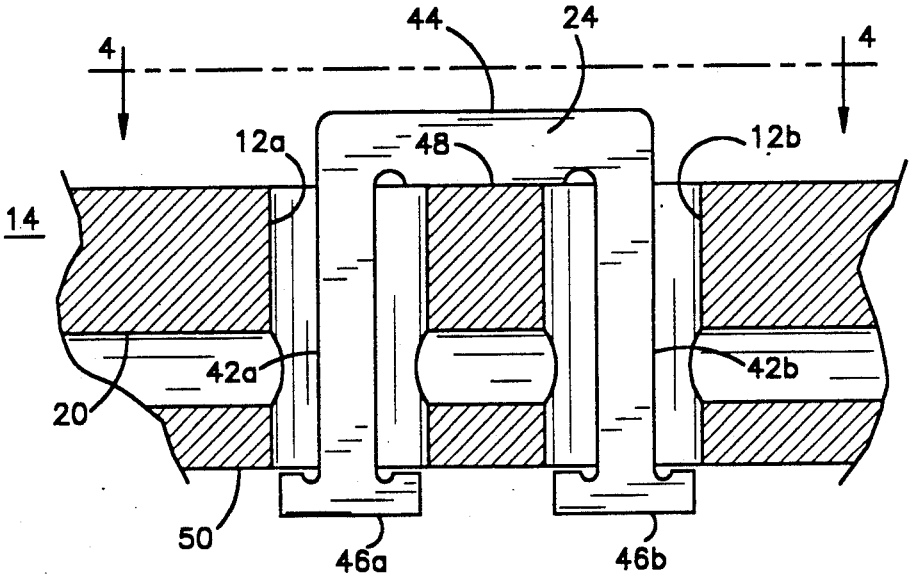
FIG. 3 is a partial cross sectional view of the apparatus shown in FIG. 1, with the valve lifters removed, taken along the line 3—3.
Figure 5:
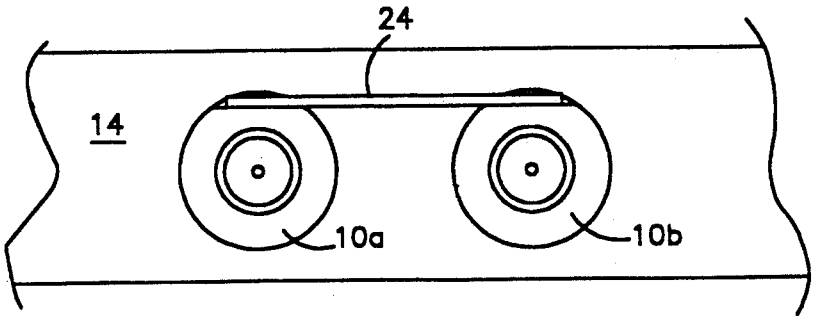
FIG. 5 is a top plan view similar to FIG. 4, but with valve lifters in the bores.

The member 24 for preventing rotation of the lifters 10 is in the preferred embodiment generally omega-shaped, with two parallel leg portions 42*a*, 42*b* connected and held in desired spaced relation by a connecting portion 44. The leg portions terminate in transverse foot portions 46*a*, 46*b*, respectively. The length of the leg portions is substantially equal to or slightly greater than the axial length of the bores 12, so that the connecting portion rests on a top surface 48 of the engine block through which the bores 12 open, and the foot portions underlie a bottom surface 50 of the engine block that is substantially parallel to the surface 48 and through which the lower ends of the bores 12 open. The foot portions 46 each have a length transverse to the leg portions that is slightly smaller than the diameter of the bores 12. As a result, when the lifters are not in the bores, the member 24 can be located above the bores in a plane that intersects the central axes of the bores, and the foot portions and the leg portions can be lowered through the bores. The member is then moved to a tangential position (see FIG. 4) within the two bores that receive the leg portions, to occupy space that will not be occupied by the lifters, because of the planar surfaces 28*b*. Once the lifters are placed in the bores 12, they return the member 24 in the tangential position and the foot portions 46 and the connecting portion 44 hold the member against vertical movement. The connecting portion 44 and the location of each leg portion in one of two bores prevent the leg portions from moving about the periphery of the bores. The fixed nature of the leg portions and the action of the leg portions against the planar portions 28*b* of the lifters prevents the lifters from rotating about their longitudinal axes. This maintains the rollers 26 in proper alignment with the operating cams of the camshaft.

In the preferred embodiment, the member 24 is flat and planar. The width and thickness of the leg portions are selected to occupy the space in the bores 12 made available by the planar surface 28*b* of the lifter bodies and to extend over as much width of the planar part as possible consistent with adequate thickness of the member 24 needed for strength and wear and to provide a clearance fit.

The preferred material of the member 24 is hardened and tempered steel alloy 4140 (conventional shim stock), or other relatively hard and good wearing material, such as aluminum-bronze alloy or so-called "half-hard" brass, etc. The member is formed without bends, and corners are shaped to avoid stress raisers. The member is not under stress when in place; i.e., it is not under tension or compression because there are no bends. Because of this, a great variety of materials can be used to form the member and it is relatively easy to inspect in manufacture.

When the member 24 and the lifters 10 are assembled in a block, lubrication of the member is provided by the bores 30. Removal and replacement of the member requires only removal of the lifters, after which the member can be removed without tools and a replacement inserted also without tools. Because the member 24 does not move in use and is not attached to the lifters, it adds no weight or load to the lifters and requires no manufacturing assembly, no additional parts and no modification of the block. Since the lifters are for use in engines that pump lubricating oil to successive lifter bores in series, the lifter bodies have no external peripheral grooves, which would allow lubricating oil to escape along the planar portions, While a preferred embodiment of the invention has been disclosed in detail, it will be understood that various modifications or alterations can be made without departing from the spirit and scope of the invention set forth in the appended claims. For example, the minor planar portion of the lifter body need not be planar. It could be of other configuration that would provide an axially extending space along the lifter body to receive a stationary leg that would prevent relative rotation of the lifter in the bore. Thus, the minor portion could be non-cylindrical but not planar, or could be cylindrical but of a different cylindrical curvature from the major body portion, and the legs of the member 24 could be shaped compatibly with the minor portion to prevent relative rotation and retain the other features and advantages of the preferred embodiment.

While the member 24 is omega-shaped and thus has two leg portions to assure it cannot move peripherally in either bore, the member can have more than two leg portions and be used with more than two bores.

In an engine block in which the oil passage 20 is tangential to the lifter bores rather than passing through them centrally, the lubricating bore 31 of the lifter body can be enlarged to bring oil in sufficient quantity and at sufficient pressure into the passage 22 to lubricate the lifter bore 12 supply oil through the passage 32 to the pushrod for the rocker arm of the valve, and supply oil through the passage 30 to lubricate the adjacent leg of the anti-rotation member 24. In that case the planar surface **28*b* and the member 24 are located on a diametrically opposite side of the bores 12** from the tangential oil passage.

We claim:

1. For use in an internal combustion engine having open-ended cylindrical bores in which valve lifters reciprocate, and a cam shaft with cams that reciprocate the lifters, and an oil passage communicating between adjacent cylindrical bores intermediate the ends of the bores and parallel to the cam shaft: a valve lifter having a body that is in major part cylindrical and in minor part non-cylindrical or of a different cylindrical curvature than the major part, the minor part extending parallel to the cylindrical axis of the major part the full axial length of the body and the major cylindrical part being of a size sufficient to obturate the oil passage, a roller cam follower supported for rotation in one end of the body about an axis transverse to the cylindrical axis, and a passage through the body parallel to the axis of rotation of the roller, opening only through the major cylindrical part of the body and of a size that overlaps the oil passage during reciprocation of the lifter in the bore.

2. For use in an internal combustion engine having open-ended cylindrical bores in which valve lifters reciprocate, and a cam shaft with cams that reciprocate the lifters, and an oil passage communicating between adjacent cylindrical bores intermediate the ends of the bores and parallel to the cam shaft: a valve lifter having a body that is in part cylindrical and in part planar, the planar part extending parallel to the cylindrical axis the full axial length of the body and the cylindrical part being of a size sufficient to obturate the oil passage, a roller cam follower supported for rotation in one end of the body about an axis transverse to the cylindrical axis, and a passage through the body parallel to the axis of rotation of the roller, opening only through the cylindrical part of the body and of a size that overlaps the oil passage during reciprocation of the lifter in the bore.

3. For use in an internal combustion engine having open-ended cylindrical bores in which valve lifters reciprocate, and a cam shaft with cams that reciprocate the lifters, and an oil passage communicating between adjacent cylindrical bores intermediate the ends of the bores and parallel to the cam shaft: a valve lifter having a body that is in major part cylindrical and in minor part non-cylindrical or of a different cylindrical curvature than the major part, the minor part extending parallel to the cylindrical axis of the major part the full axial length of the body and the major cylindrical part being of a size sufficient to obturate the oil passage, a roller cam follower supported for rotation in one end of the body about an axis transverse to the cylindrical axis, and a passage through the body parallel to the axis of rotation of the roller, opening only through the major cylindrical part of the body and of a size that overlaps the oil passage during reciprocation of the lifter in the bore; and a member constructed and arranged to extend into the bore at a stationary location out of alignment with the oil passage and to engage the minor part to restrain rotation of the body about its axis without interfering with reciprocation.

4. A valve lifter and member as set forth in claim 3 wherein said member has a portion that is constructed and arranged to remain external to the bore in which the body reciprocates and that inhibits movement of the member relative to the bore.

5. A valve lifter and member as set forth in claim 3 including a second member constructed and arranged to extend into a second bore, and means connecting the two members outside of said bore so the second member inhibits movement of the first.

6. A valve lifter and member as set forth in claim 5 wherein the connecting means is constructed and arranged to be parallel to the oil passage and offset therefrom laterally.

7. For use in an internal combustion engine having open-ended cylindrical bores in which valve lifters reciprocate, and a cam shaft with cams that reciprocate the lifters, and an oil passage communicating between adjacent cylindrical bores intermediate the ends of the bores and parallel to the cam shaft: a valve lifter having a body that is in part cylindrical and in part planar, the planar part extending parallel to the cylindrical axis and the cylindrical part being of a size sufficient to obturate the oil passage, a roller cam follower supported for rotation in one end of the body about an axis transverse to the cylindrical axis, and a passage through the body parallel to the axis of rotation of the roller, opening only through the cylindrical part of the body and of a size that overlaps the oil passage during reciprocation of the lifter in the bore; and a member constructed and arranged to extend into the bore at a stationary location out of alignment with the oil passage and to engage the planar part to restrain rotation of the body about its axis without interfering with reciprocation.

8. A valve lifter and member as set forth in claim 7 wherein said member has a portion that is constructed and arranged to remain external to the bore in which the body reciprocates and that inhibits movement of the member relative to the bore only when the lifter is in the bore.

9. A member at least in part generally omega-shaped adapted to fit into at least two spaced parallel valve lifter bores of an internal combustion engine, said member having two leg portions, a transverse portion connecting upper ends of the two leg portions, and a transverse foot portion at a lower end of at least one leg portion shorter in length than the diameter of the lifter bores, said leg, connecting and foot portions all lying in a common plane; the leg portions being of a length sufficient to extend entirely through the lifter bores and the member being formed from flat material and unbent, essentially free of internal stress and insertable in the lifter bores without deformation.

10. In combination, an internal combustion engine block having open-ended cylindrical bores in which valve lifters reciprocate, and a cam shaft with cams that reciprocate the lifters, and an oil passage communicating between adjacent cylindrical bores intermediate the ends of the bores and parallel to the cam shaft, a valve lifter in each of said bores having a body that is in major part cylindrical and in minor part non-cylindrical or of a different cylindrical curvature than the major part, the minor part extending parallel to the cylindrical axis of the major part the full axial length of the body and the major cylindrical part being of a size sufficient to obturate the oil passage, a roller cam follower supported for rotation in one end of the body about an axis transverse to the cylindrical axis, and a passage through the body parallel to the axis of rotation of the roller, opening only through the major cylindrical part of the body and of a size that overlaps the oil passage during reciprocation of the lifter in the bore.

11. In combination, a high speed automotive internal combustion engine having open-ended cylindrical bores in which valve lifters reciprocate, and a cam shaft with cams that reciprocate the lifters, and an oil passage communicating between adjacent cylindrical bores intermediate the ends of the bores and parallel to the cam shaft, a valve lifter in each bore having a body that is in major part cylindrical and in minor part non-cylindrical or of a different cylindrical curvature than the major part, the minor part extending parallel to the cylindrical axis of the major part the full axial length of the body and the major cylindrical part being of a size sufficient to obturate the oil passage, a roller cam follower supported for rotation in one end of the body about an axis transverse to the cylindrical axis, and a passage through the body parallel to the axis of rotation of the roller, opening only through the major cylindrical part of the body and of a size that overlaps the oil passage during reciprocation of the lifter in the bore, and members extending into each bore at a stationary location out of alignment with the oil passage and engaging the minor part and restraining rotation of the body about its axis without interfering with reciprocation.

12. The combination as set forth in claim 11 wherein said members are at least in part generally omega-shaped, having two leg portions each extending into an adjacent bore, a transverse portion connecting upper ends of the two leg portions above the bores, the leg portions being of lengths sufficient to extend entirely through the bores, and a foot portion at the end of each leg portion remote from the transverse portion, located below the bores and extending transversely of the leg portions a distance greater than the width of the leg portions and less than the diameter of the bores, said members being formed from flat material and unbent, essentially free of internal stress and insertable in the bores without deformation.

* * * * *